US010575599B2

(12) United States Patent
Cheng

(10) Patent No.: US 10,575,599 B2
(45) Date of Patent: Mar. 3, 2020

(54) WATERTIGHT SLIDE FASTENER

(71) Applicant: UNITECH ZIPPER & MACHINERY CO., LTD., New Taipei (TW)

(72) Inventor: Jung-Yuan Cheng, New Taipei (TW)

(73) Assignee: Unitech Zipper & Machinery Co., Ltd., New Taipei (TW)

( * ) Notice: Subject to any disclaimer, the term of this patent is extended or adjusted under 35 U.S.C. 154(b) by 0 days.

(21) Appl. No.: 16/150,394

(22) Filed: Oct. 3, 2018

(65) Prior Publication Data

US 2019/0142116 A1 May 16, 2019

(30) Foreign Application Priority Data

Nov. 13, 2017 (TW) ..... 106139187 A

(51) Int. Cl.

| | |
|---|---|
| ***A44B 19/32*** | (2006.01) |
| ***A44B 19/34*** | (2006.01) |
| ***A44B 19/26*** | (2006.01) |
| ***A44B 19/30*** | (2006.01) |

(52) U.S. Cl.

CPC ..... *A44B 19/32* (2013.01); *A44B 19/26* (2013.01); *A44B 19/301* (2013.01); *A44B 19/34* (2013.01)

(58) Field of Classification Search

CPC ..... A44B 19/32; A44B 19/36; A44B 19/26; A44B 19/301; A44B 19/24; Y10T 24/2514; Y10T 24/2511; Y10T 24/2598

See application file for complete search history.

(56) References Cited

U.S. PATENT DOCUMENTS

| | | | | |
|---|---|---|---|---|
| 4,524,493 | A * | 6/1985 | Inamura | A44B 19/32 24/389 |
| 4,825,514 | A * | 5/1989 | Akeno | A44B 19/32 24/387 |
| 5,253,395 | A * | 10/1993 | Yano | A44B 19/265 24/387 |
| 7,591,051 | B2 | 9/2009 | Kusayama et al. | |
| 9,138,033 | B2 * | 9/2015 | Kojima | A44B 19/26 |
| 9,314,069 | B2 * | 4/2016 | Takazawa | A44B 19/32 |

FOREIGN PATENT DOCUMENTS

JP H0436659 Y2 8/1992

* cited by examiner

*Primary Examiner* — Jack W Lavinder

(74) *Attorney, Agent, or Firm* — Alan D. Kamrath; Karin L. Williams; Mayer & Williams PC

(57) ABSTRACT

A watertight slide fastener includes two tapes each having a waterproof layer. Each of the two tapes includes an inner edge on which a plurality of consecutively disposed scoops and an upper stopper scoop made of a rigid plastic are mounted. A first end of each upper stopper scoop is contiguous to the last one of the plurality of scoops. A second end of each upper stopper scoop has an extension. A top end stop is formed on upper and lower faces of each of the two tapes by an elastomer and envelops an upper face and a lower face of each extension. Each of two outer sides of the top end stop has a shoulder. A slider includes an upper body and a lower body interconnected to the upper body by a diamond. Each of two sides of the upper and lower bodies has a flange.

12 Claims, 12 Drawing Sheets

WATERTIGHT SLIDE FASTENER

CROSS REFERENCE TO RELATED APPLICATION

The application claims the benefit of Taiwan application serial No. 106139187, filed on Nov. 13, 2017, and the entire contents of which are incorporated herein by reference.

BACKGROUND OF THE INVENTION

1. Field of the Invention

The present invention relates to a watertight slide fastener and, more particularly, to a watertight slide fastener preventing leakage through a top end stop thereof.

2. Description of the Related Art

FIG. 1 shows a conventional slide fastener 8 including a pair of fastener tapes 81. Scoops 82 are disposed on two mutually facing edges of the fastener tapes 81. A resilient top end stop 83 is mounted on the fastener tapes 81 and is connected to the scoops 82. The resilient top end stop 83 includes an accommodating portion 84 in a central portion thereof for accommodating a stud 86 of a slider 85. A protrusion 87 extends upright along a periphery of the resilient top end stop 83. A passage portion 88 is defined in an entrance of the resilient top end stop 83. Flanges 89 of the slider 85 press against two outer edges of the resilient top end stop 83 to sealingly close the passage portion 88. An example similar to the conventional slide fastener 8 is disclosed in JP Publication No. 4-36659. In the conventional slide fastener 8, the sealing closure of the passage portion 88 merely relies on the pressure against the two outer edges of the resilient top end stop 83 by the flanges 89 of the slider 85. In a case that the force pressing against the two outer edges of the resilient top end stop 83 is insufficient, leakage is apt to occur at the passage portion 88.

FIG. 2 shows another conventional slide fastener 9 designed to improve the above leakage problem. The conventional slide fastener 9 also includes a pair of fastener tapes 91, scoops 92 disposed on two mutually facing edges of the fastener tapes 91, and a resilient top end stop 93 separate from the scoops 92. The resilient top end stop 93 includes an accommodating portion 94 for accommodating a stud 96 of a slider 95. A protrusion 97 extends upright along a periphery of the resilient top end stop 93. A passage portion 98 is defined in an entrance of the resilient top end stop 93. A pair of pressing portions 99 is disposed on outer edges of the resilient top end stop 93 and corresponds to the passage portion 98. The resilient top end stop 93 and the pressing portions 99 can be pressed by flanges 90 of the slider 95 to sealingly close the passage portion 98, attaining better impermeability to water and air. An example similar to the conventional slide fastener 9 is disclosed in U.S. Pat. No. 7,591,051 B2 (Taiwan Patent Publication No. 200716008) entitled "WATERPROOF TOP END STOP OF SLIDE FASTENER."

The resilient top end stop 93 is made of an elastic, soft material, and slider 95 is made of a rigid material such as zinc alloy or hardened plastic material added with fillings (such as fiberglass, fibers, etc.). The transverse dimension of the resilient top end stop 93 is larger than that of the interior of the flanges 90 of the slider 95. For example, a #10 slide fastener generally has a tolerance of 10% in the dimension. Thus, a larger lateral force imparted to the flanges 90 of the slider 95 is required to press against the resilient top end stop 93 and the pressing portions 99 for sealingly closing the passage portion 98 of the resilient top end stop 93, thereby attaining impermeability to water and air. Nevertheless, the resilient top end stop 93 made of the resilient material will generate an interfering force resisting the compression. In this case, pulling the slider 95 for opening or closing the scoops 92 becomes difficult and needs a larger force. Furthermore, after a period of time of repetitious use of the slide fastener 9, the resilient top end stop 93 made of soft material becomes worn due to repeated rubbing by the slider 95, adversely affecting the sealing closure of the passage portion 98 and failing to attain the impermeability to water and air.

Thus, improvement to the conventional slide fasteners is necessary.

SUMMARY OF THE INVENTION

To solve the above problems, an objective of the present invention is to provide a watertight slide fastener with a smaller interference amount, such that the slider can be easily pulled for opening and closing operations.

Another objective of the present invention is to provide a watertight slide fastener including a top end stop that can withstand long-term repetitious rubbing by the slider while reducing abrasion of the top end stop and prolonging the service life of the watertight slide fastener.

A further objective of the present invention is to provide a watertight slide fastener including a top end stop that still has better impermeable effects to liquid and air after long-term use.

When the terms "front", "rear", "up", "down", "top", "bottom", "inner", "outer", and similar terms are used herein, it should be understood that these terms have reference only to the structure shown in the drawings as it would appear to a person viewing the drawings and are utilized only to facilitate describing the invention, rather than restricting the invention.

A side of a scoop on one of two tapes engaging with a side of a corresponding scoop on the other tape is defined as "inner side," and the other side of the scoop is defined as "outer side."

A watertight slide fastener according to the present invention includes two tapes, with each of the two tapes including a waterproof layer. Each of the two tapes includes an inner edge on which a plurality of consecutively disposed scoops and an upper stopper scoop are mounted. The plurality of scoops and the upper stopper scoop are made of a rigid plastic. The upper stopper scoop on each of the two tapes includes a first end contiguous to a last one of the plurality of scoops on the respective one of the two tapes. The upper stopper scoop of each of the two tapes includes a second end having an extension. The second end of the upper stopper scoop of each of the two tapes includes an outer side having a minor protruding portion with a surface more protrusive than a surface of the first end of the upper stopper scoop. A top end stop is formed on an upper face and a lower face of each of the two tapes by an elastomer. The top end stop envelops an upper face and a lower face of each extension. The top end stop includes two outer sides. Each of the two outer sides of the top end stop has a shoulder. A slider includes an upper body and a lower body. The upper body and the lower body are interconnected by a stud. Each of the upper body and the lower body includes two sides. Each of the two sides of each of the upper body and the lower body has a flange.

Thus, in the watertight slide fastener according to the present invention, since only the first shoulder portions of the top end stop is made of rigid plastic, since the second shoulder portions are elastomer that completely or partially envelops the extensions, and since the third shoulder portions are not in contact or in slight contact with the slider, the lateral dimension difference between the top end stop and the interior of the flanges of the slider can be reduced. Thus, the top end stop imparts a smaller interference amount and a small resistance to permit easy pulling of the slider. Furthermore, the two upper stopper scoop made of rigid plastic can withstand long-term frictional contact with the slider to reduce the abrasion of the two upper stopper scoops. Thus, even after long-term use of the top end stop, the passage portion of the top end stop can still have a better sealing closing effect to attain a better impermeability effect to liquid and air, thereby prolonging the service life of the top end stop.

In an example, an outer side of each extension is flush with a respective one of the minor protruding portions, such that the outer side of each extension is exposed and not enveloped by the elastomer. Thus, the dimension difference between the slider and the extensions can be reduced, such that a smaller sliding resistance exists between the slider and the extensions when the slider comes into contact with the extensions, permitting easy pulling of the slider.

In an example, the outer side of each extension includes a recessed portion recessed into a surface of the extension, and the elastomer of the top end stop fills the recessed portion. Thus, the dimension difference between the slider and the extensions can be reduced, such that a smaller sliding resistance exists between the slider and the extensions when the slider comes into contact with the extensions, permitting easy pulling of the slider.

In an example, each shoulder of the top end stop includes a first shoulder portion, a second shoulder portion, and a third shoulder portion. Each first shoulder portion corresponds to a respective one of the minor protruding portions. Each second shoulder portion corresponds to a respective one of the extensions. Each third shoulder portion is a remaining portion beyond a distal end of the respective one of the extensions. Thus, the dimension difference between the slider and the extensions can be reduced, such that a smaller sliding resistance exists between the slider and the extensions when the slider comes into contact with the extensions, permitting easy pulling of the slider.

In an example, each third shoulder portion includes at least one pressure releasing portion in a form of a recess in a respective one of the shoulders. Thus, the contact area between the shoulders and the slider can be reduced to permit easy pulling of the slider.

In an example, the top end stop includes an accommodating portion extending from an upper face through a lower face of the top end stop. The accommodating portion includes a periphery having a protrusion protruding therefrom and a stopper portion. The protrusion is configured to abut against an inner face of the upper body and an inner face of the lower body. Thus, the watertight slide fastener has a better water-resistant effect.

In an example, the upper stopper scoops of the two tapes are made of a rigid plastic. Thus, the abrasion of the upper stopper scoops and the slider is reduced.

In an example, the elastomer is thermoplastic polyurethane (TPU), nylon thermoplastic elastomer, or synthetic rubber. Thus, the slider can be tightly pressed.

In an example, each extension is symmetrically formed on an upper face and a lower face of a respective one of the two tapes. Thus, the extensions can uniformly force the passage portion to close tightly.

In an example, each extension is inclined or curved. Thus, the slider can be pulled easily.

In an example, the extensions have an identical inclination angle or an identical curvature. Thus, the slider can be pulled evenly.

In an example, each extension extends rectilinearly or non-rectilinearly. Thus, the elastomer of the top end stop and the extensions have a more reliable mounting effect.

The present invention will become clearer in light of the following detailed description of illustrative embodiments of this invention described in connection with the drawings.

DETAILED DESCRIPTION OF THE INVENTION

Figure 4:
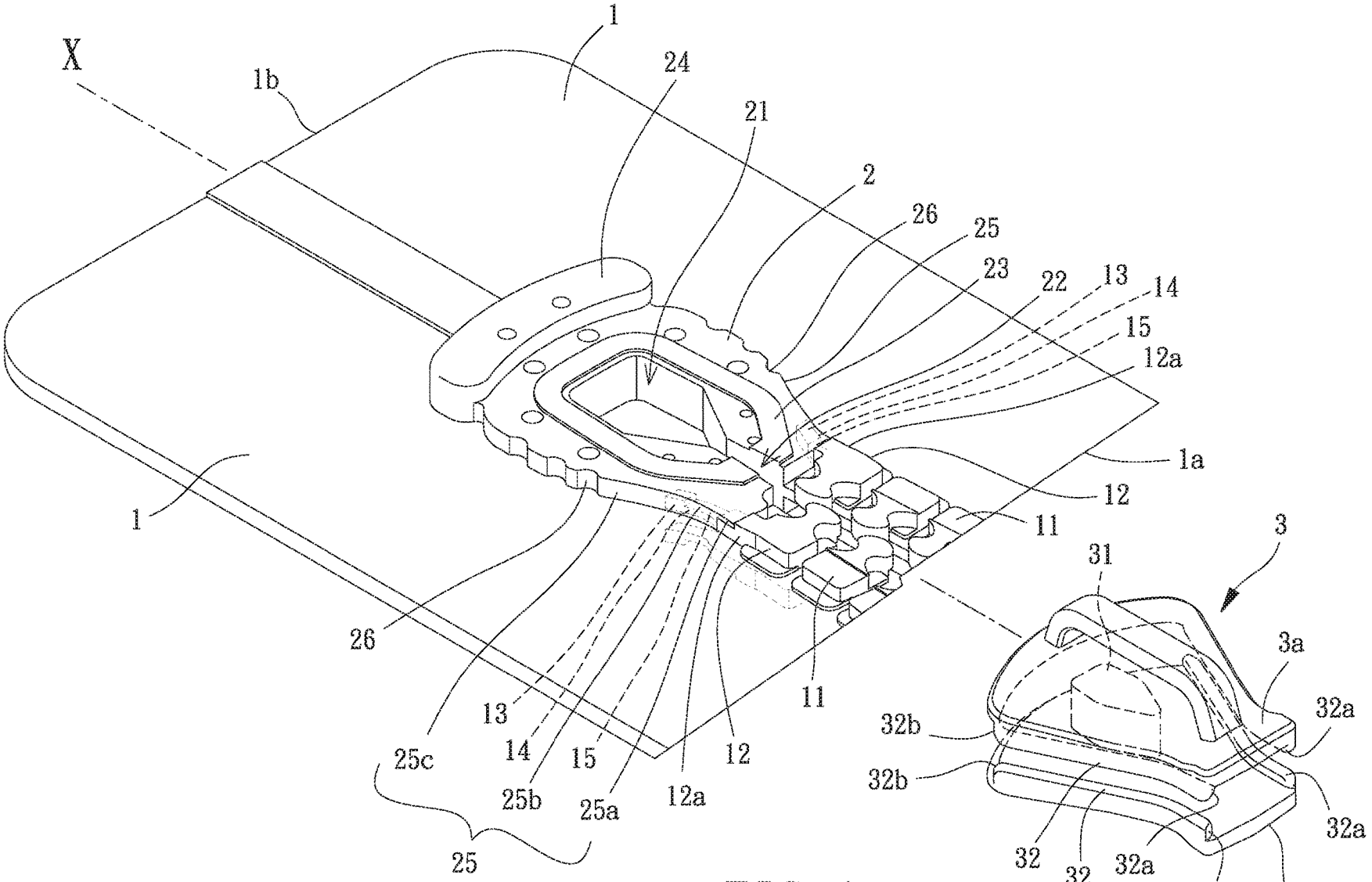
FIG. 4 is an exploded, perspective view of the watertight slide fastener of the first embodiment according to the present invention.

With reference to FIG. 4, a watertight slide fastener of a first embodiment according to the present invention includes two tapes 1, a top end stop 2, and a slider 3. Each of the two tapes 1 includes an inner edge on which a plurality of scoops 11 is mounted. The top end stop 2 is contiguous to the last one of the plurality of scoops 11. The slider 3 is configured to close or separate the scoops 11 and the top end stop 2.

Figure 1:
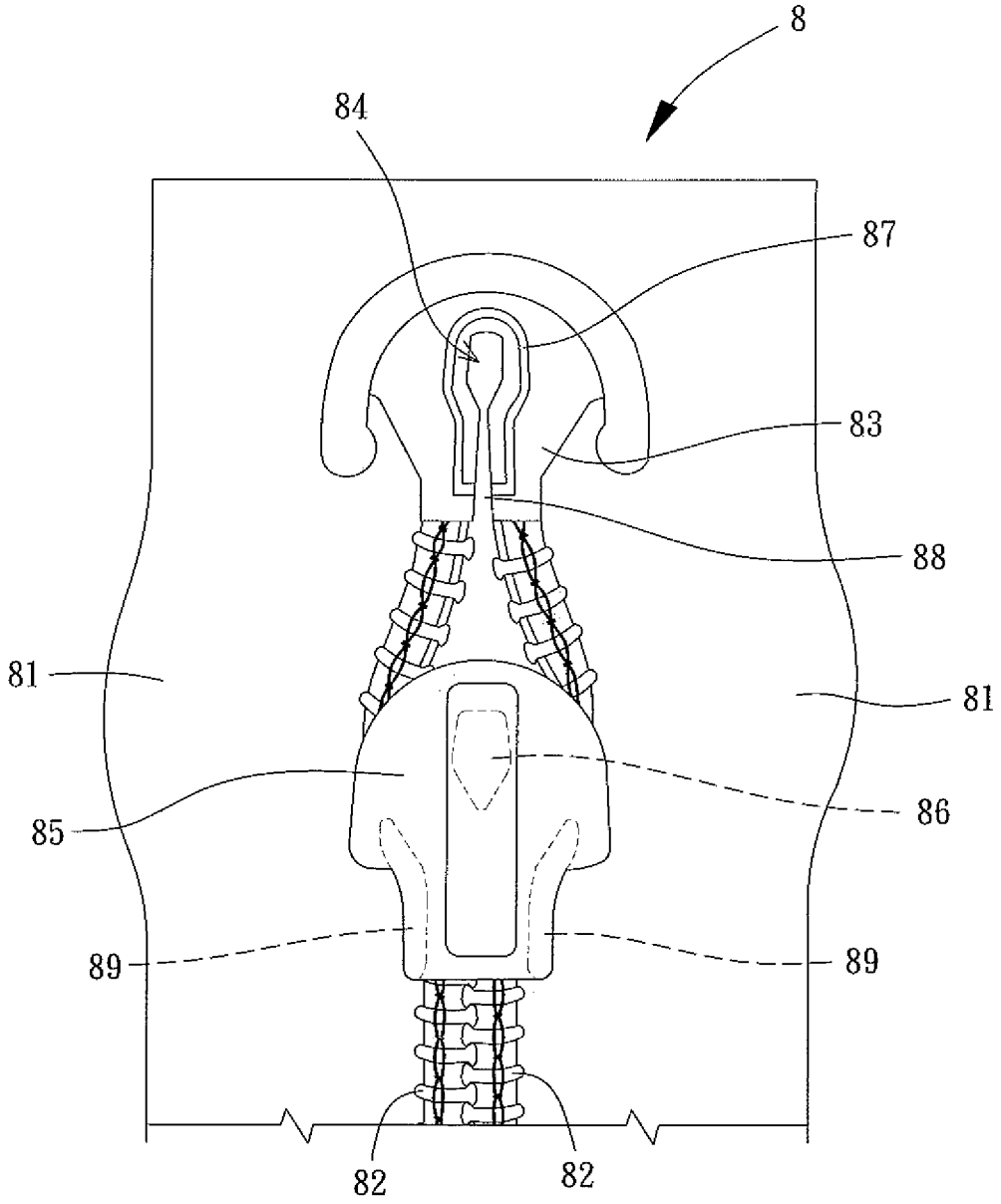
FIG. 1 PRIOR ART
FIG. 1 is a top view of a conventional slide fastener.
Figure 2:
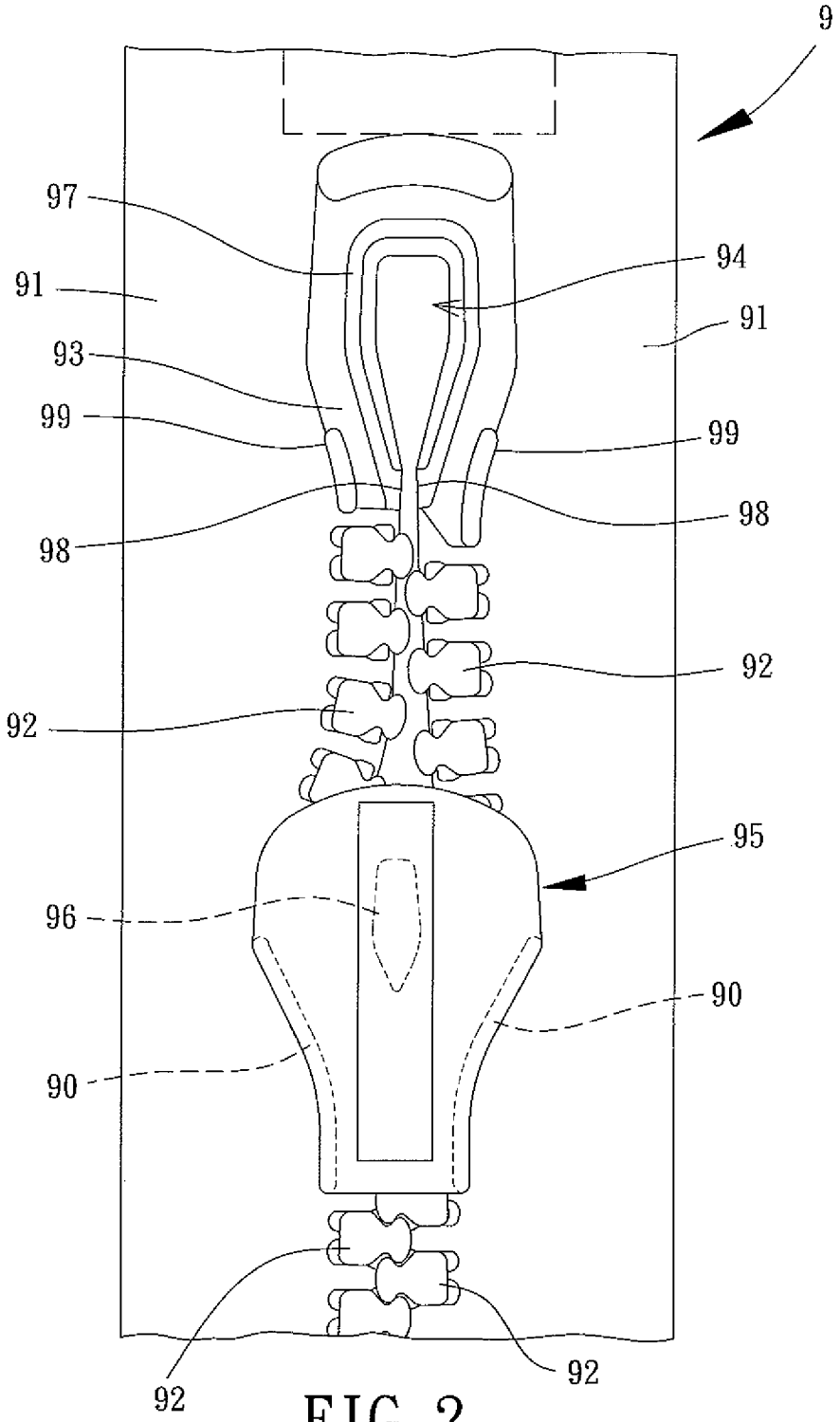
FIG. 2 PRIOR ART
FIG. 2 is a top view of another conventional slide fastener.
Figure 3:
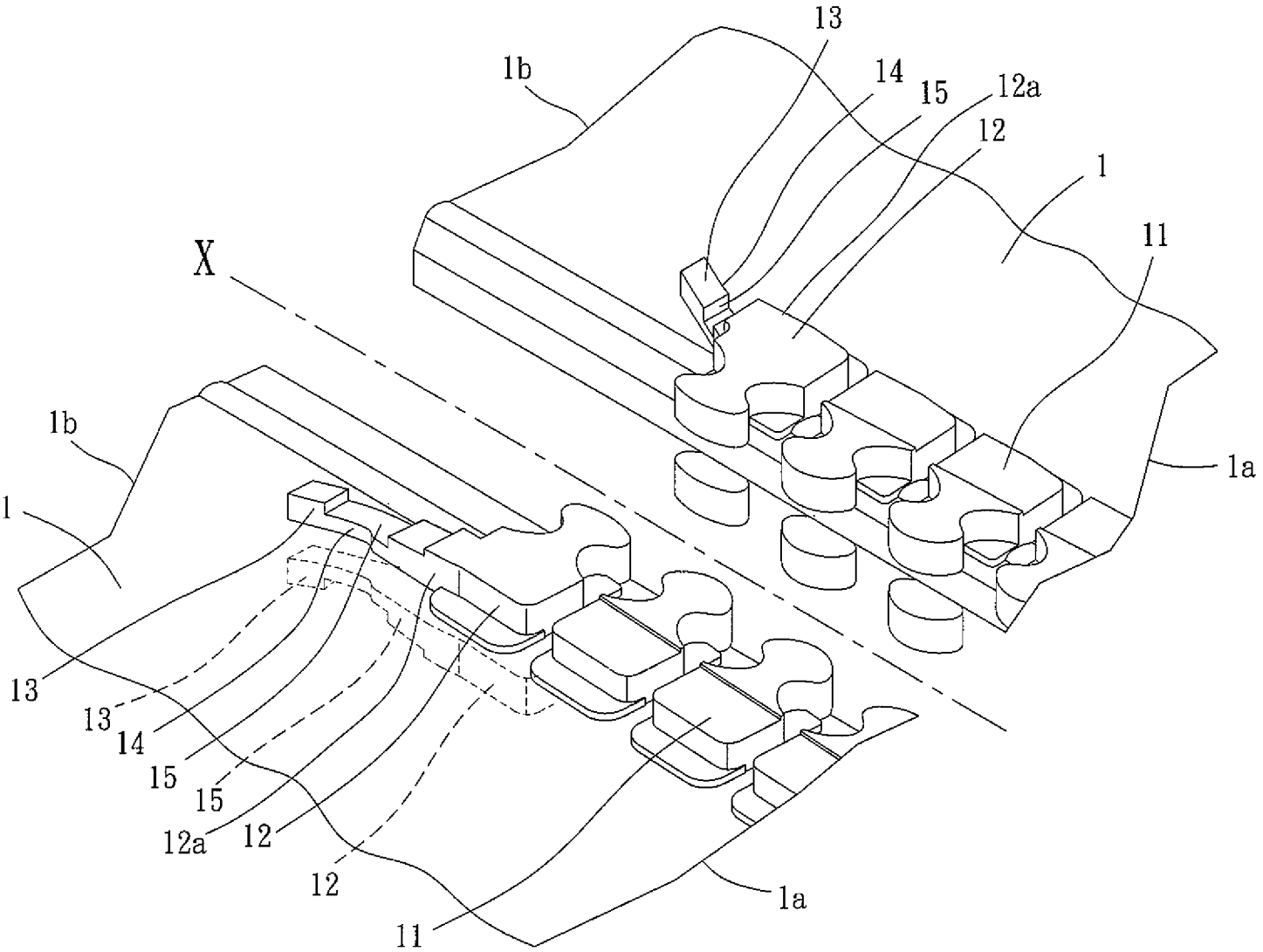
FIG. 3 is a partial, exploded, prospective view of a watertight slide fastener of a first embodiment according to the present invention.

FIG. 3 shows the structure of the two tapes 1. Each of the two tapes 1 includes a first end 1*a* and a second end 1*b*. Furthermore, each of the two tapes 1 includes a waterproof layer. As an example, the waterproof layer can be obtained by heating a thermoplastic resin which is then extruded or injected to envelop the two tapes 1 to provide the two tapes 1 with impermeability to liquid and water. Each of the inner edges of the two tapes 1 facing each other is provided with the plurality of scoops 11 and an upper stopper scoop 12. The plurality of scoops 11 on each of the two tapes 1 is consecutively disposed from the first end 1*a* towards the second end 1*b*. Each upper stopper scoop 12 is adjacent to the second end 1*b*. The plurality of scoops 11 and the upper stopper scoops 12 are made of a rigid plastic. In the present invention, the hardness of the rigid plastic is preferably larger than thermoplastic polyurethane (TPU), nylon thermoplastic elastomer, or synthetic fiber. The rigid plastic can be a thermoplastic resin, such as polyamide (PA), polyamide blend, an elastomer added with fiberglass, or an elastomer blend. Additives and mixtures can be added into the thermoplastic resin. The rigid plastic is disposed on the inner edges of the two tapes 1 by injection molding. The plurality of scoops 11 and the upper stopper scoops 12 are simultaneously formed on upper and lower faces of the two tapes 1. The plurality of scoops 11 of the two tapes 1 can mesh with each other along a central axis X.

The upper stopper scoop 12 on each of the two tapes 1 includes a first end contiguous to the last one of the plurality of scoops 11 on the respective one of the two tapes 1 and has a shape and structure similar to the scoops 11. Thus, the upper stopper scoops 12 on the two tapes 1 can mesh with each other. The upper stopper scoop 12 of each of the two tapes 1 includes a second end having an extension 13. Furthermore, the second end of the upper stopper scoop 12 of each of the two tapes 1 includes an outer side having a minor protruding portion 12*a* with a surface more protrusive than a surface of the first end of the upper stopper scoop 12. A thickness between an upper face and a lower face of each extension 13 is preferably smaller than a thickness between an upper face and a lower face of each upper stopper scoop 12. Thus, the thickness of each extension 13 is smaller than that of each upper stopper scoop 12. Each extension 13 includes an outer side extending from the respective minor protruding portion 12*a*. The distal ends of two extensions 13 extending in a direction reverse to the meshing direction, such that each extension 13 has an inclination angle or a curvature extending outward away from the central axis X. Preferably, the extensions 13 have an identical inclination angle or an identical curvature. Furthermore, the outer side of each extension 13 includes a recessed portion 14 recessed into a surface of the extension 13. Preferably, two notches 15 are symmetrically formed on the extensions 13 on upper and lower faces of each of the two tapes 1. Preferably, the recessed portion 14 and the notch 15 correspond to each other and are recessed into two surfaces of a respective extension 13.

Figure 5:
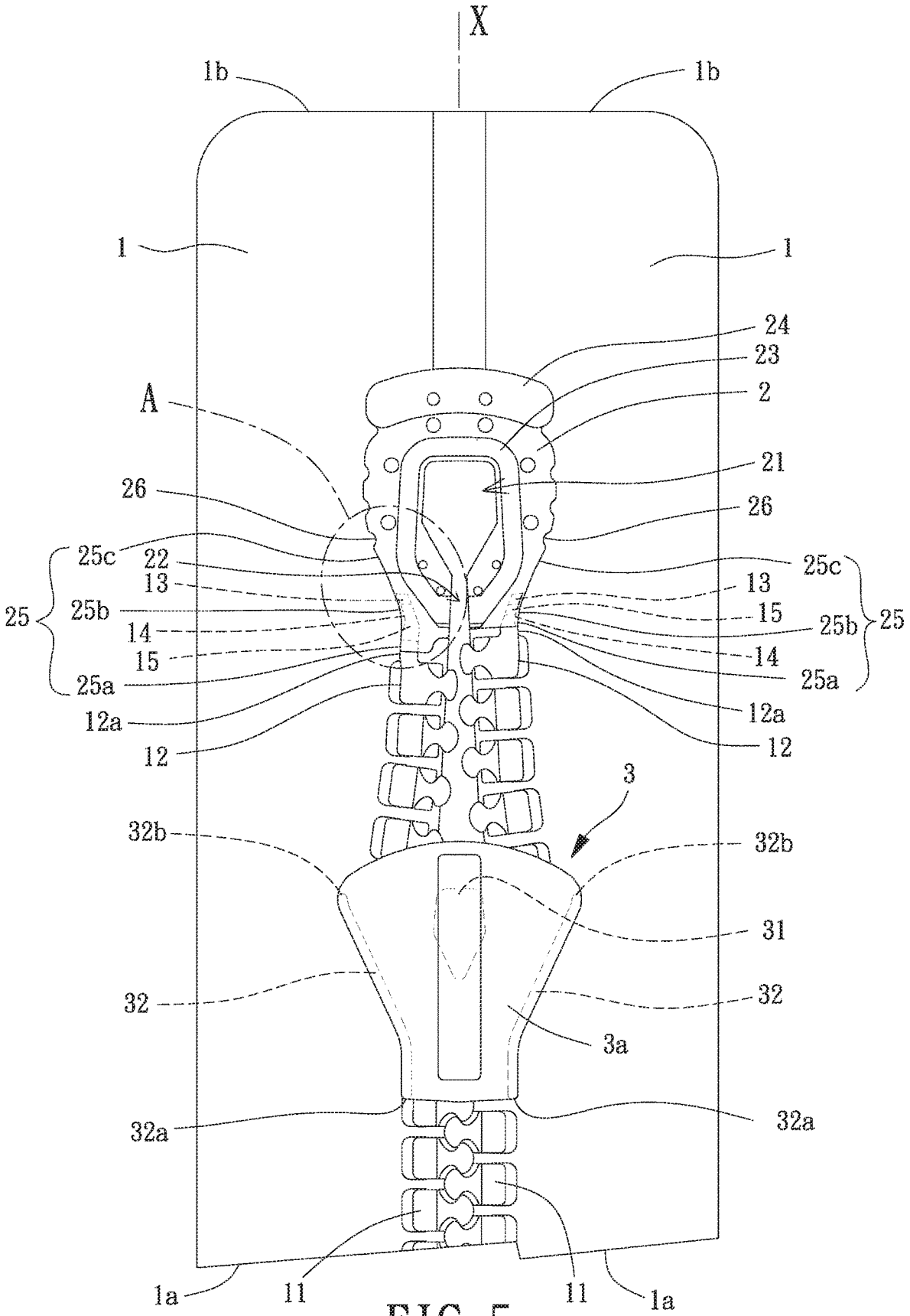
FIG. 5 is a top view of the watertight slide fastener of the first embodiment according to the present invention after assembly.

With reference to FIGS. 4 and 5, the top end stop 2 is formed on an upper face and a lower face of each of the two tapes 1 and is made of an elastomer. The top end stop 2 is preferably formed on the upper and lower faces of each of the two tapes 1 by thermoplastic polyurethane (TPU), nylon thermoplastic elastomer, or synthetic rubber through injection molding. Furthermore, the elastomer can envelop an upper face and a lower face of each extension 13 to form surfaces that are flush with the two upper stopper scoops 12. Furthermore, the elastomer can fill the recessed portions 14 and the notches 15 of the two extensions 13. Thus, the top end stop 2 can be securely disposed on the two tapes 1 and the two extensions 13.

With reference to FIGS. 4 and 5, the top end stop 2 includes an accommodating portion 21 extending from an upper face through a lower face of the top end stop 2. The accommodating portion 21 is configured to receive a stud 31 of the slider 3 that has a diamond-shaped cross-section. The accommodating portion 21 includes a passage portion 22 corresponding to the extensions 13. The passage portion 22 permits easy passage of the stud 31 of the slider 3. The accommodating portion 21 further includes a periphery having a protrusion 23 protruding therefrom and a stopper portion 24 protruding away from the upper face and the lower face of the accommodating portion 21.

Figure 6:
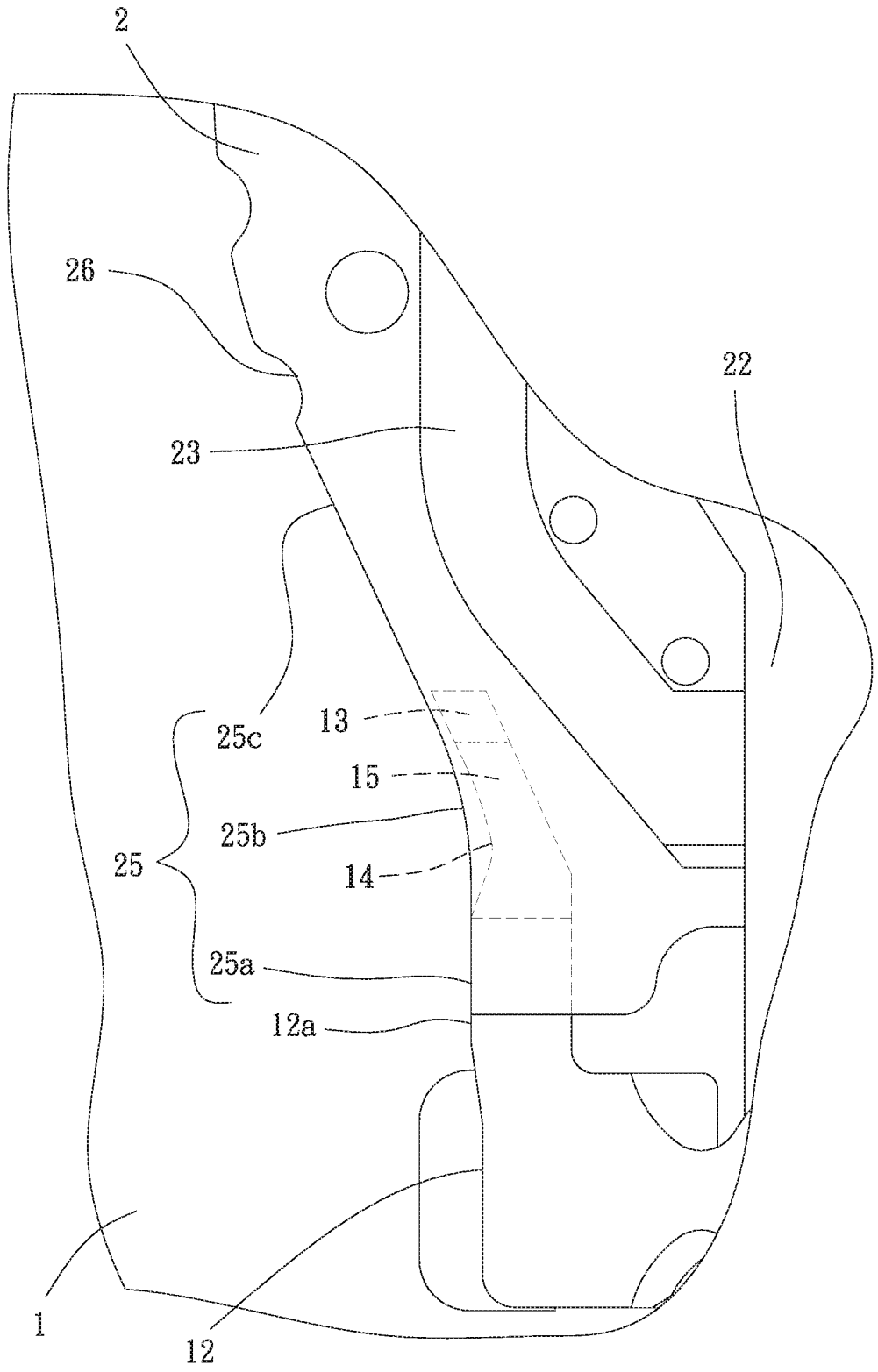
FIG. 6 is an enlarged view of a circled portion A of FIG. 5.

The top end stop 2 further includes two outer sides. Each of the two outer sides of the top end stop 2 has a shoulder 25. Each shoulder 25 includes a first shoulder portion 25*a*, a second shoulder portion 25*b*, and a third shoulder portion 25*c* (FIG. 6). Each first shoulder portion 25*a* corresponds to the minor protruding portion 12*a* of a respective one of the upper stopper scoops 12 made of rigid plastic. Each second shoulder portion 25*b* is enveloped by the elastomer and fills a respective one of the extensions 13 made of rigid plastic and its recessed portion 14. Each third shoulder portion 25*c* is a remaining portion beyond a distal end of the recessed portion 14 of the respective one of the upper stopper scoops 12. Furthermore, each third shoulder portion 25*c* preferably includes at least one pressure releasing portion 26 in the form of a recess in a respective one of the third shoulder portions 25*c* to reduce the contact area between the third shoulder portion 25*c* and the slider 3.

Figure 7:
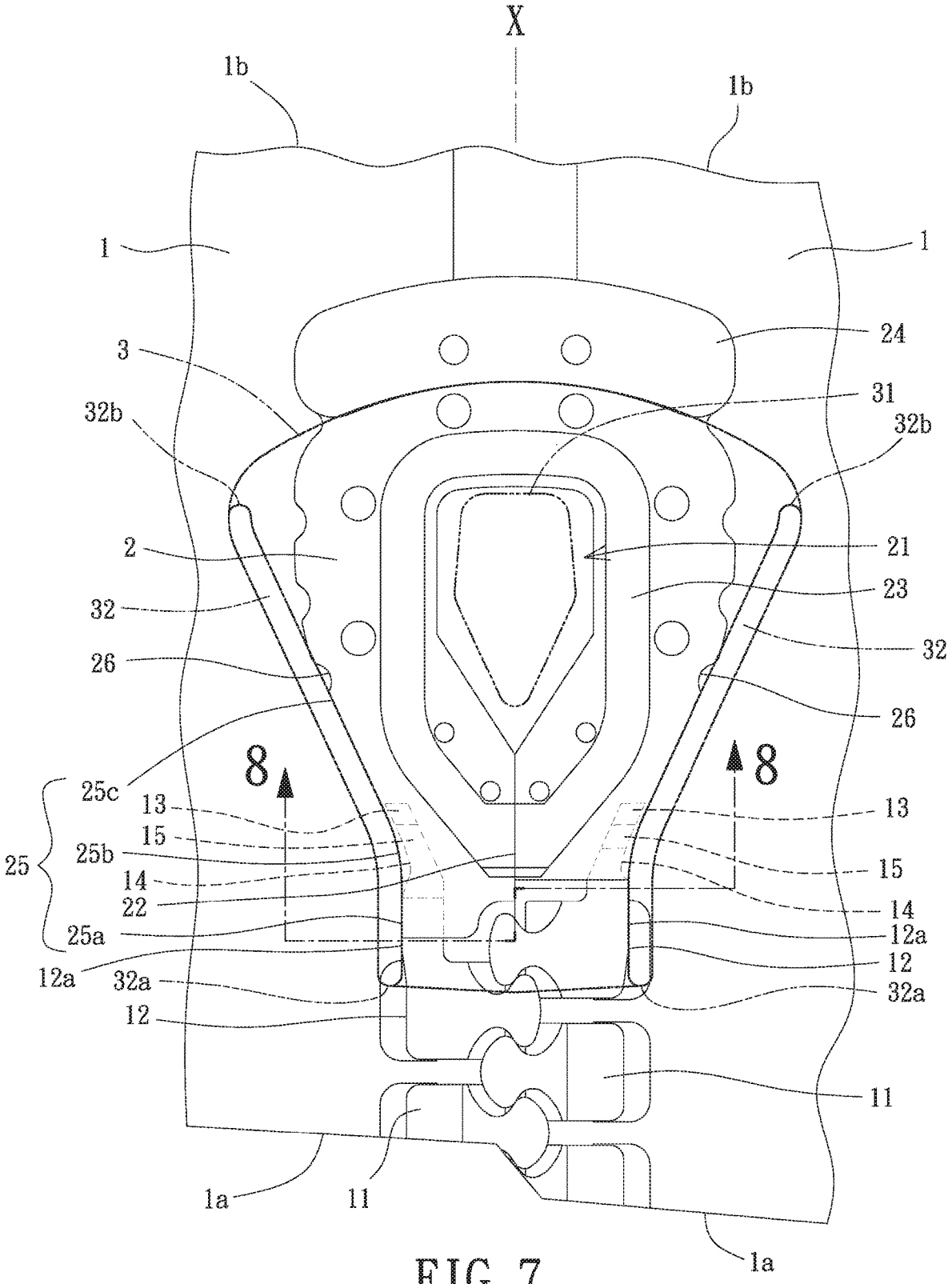
FIG. 7 is a diagrammatic view illustrating the watertight slide fastener and its top end stop of the first embodiment according to the present invention in a closure state.

With reference to FIGS. 5 and 7, the slider 3 is made of rigid material and can be of a conventional structure. The slider 3 includes an upper body 3*a* and a lower body 3*b*. The upper body 3*a* and the lower body 3*b* are interconnected by the stud 31. Each of the upper body 3*a* and the lower body 3*b* includes two sides. Each of the two sides of each of the upper body 3*a* and the lower body 3*b* has a flange 32. Two flanges 32 on the same sides of the upper and lower bodies 3*a* and 3*b* protrude toward each other. Each flange 32 of the upper and lower bodies 3*a* and 3*b* has a rear end 32*a* and a front end 32*b*. The protrusion 23 of the top end stop 2 can abut against the inner faces of the upper and lower bodies 3*a* and 3*b* to provide a better impermeability effect to liquid and air. The stud 31 of the slider 3 can easily pass through the passage portion 22 of the top end stop 2 and can be received in the accommodating portion 21.

Figure 8:
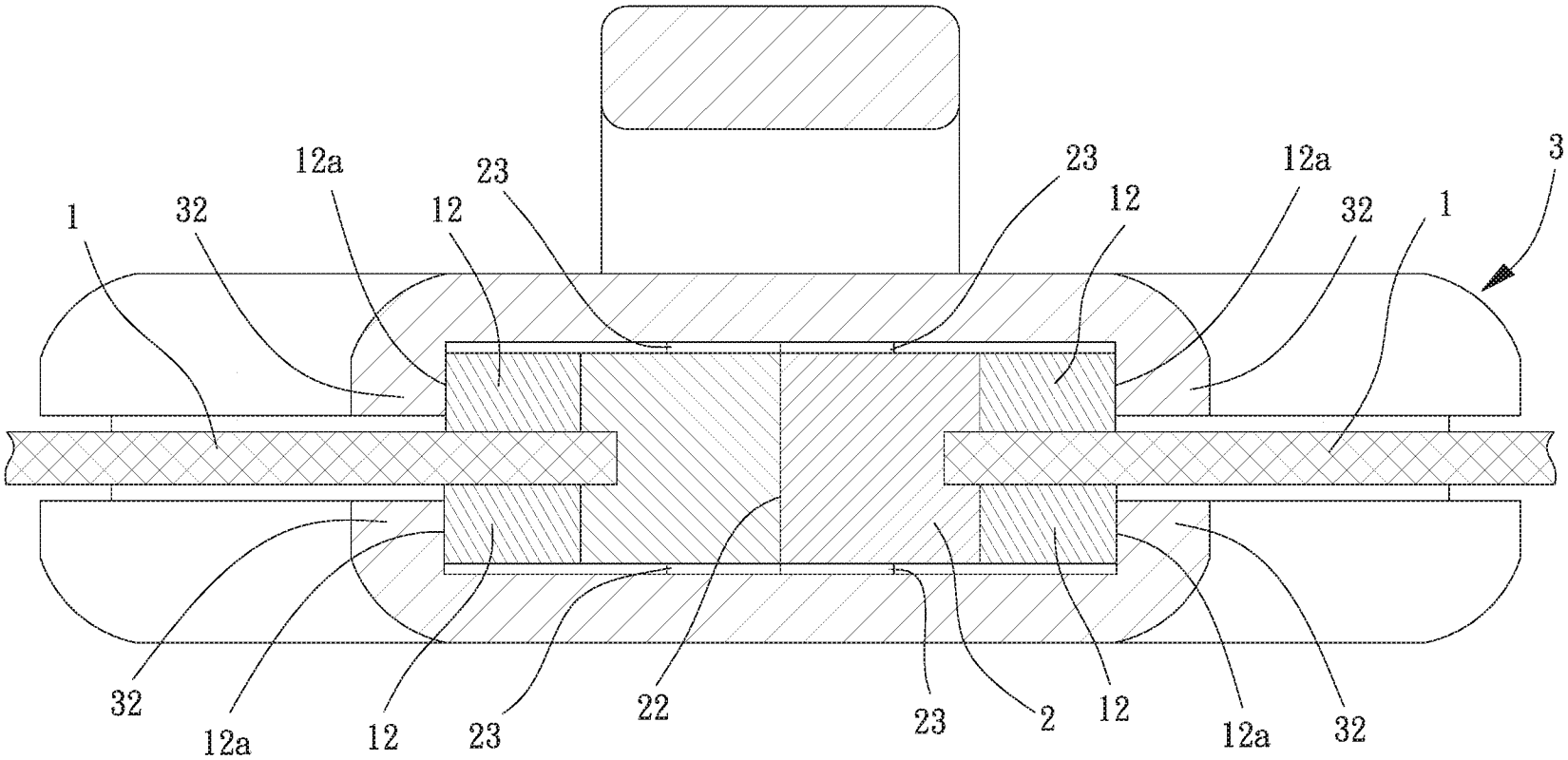
FIG. 8 is a cross sectional view taken along section line 8-8 of FIG. 7.

With reference to FIGS. 5 and 7, when the slider 3 moves from the first ends 1*a* toward the second ends 1*b* of the two tapes 1, each flange 32 and its rear end 32*a* guide and force the plurality of scoops 11 of the two tapes 1 to mesh with each other. Furthermore, each flange 32 and its front end 32*b* press against the respective shoulders 25 of the top end stop 2. Firstly, the rear ends 32*a* of the flange 32 of the slider 3 press against the first shoulder portion 25*a*. Namely, the rear ends 32*a* of the flanges 32 of the slider 3 press against the minor protruding portions 12*a* of the two upper stopper scoops 12. Since the minor protruding portions 12*a* of the two upper stopper scoops 12 are made of rigid plastic, the rear ends 32*a* of the flanges 32 of the slider 3 can assure meshing of the plurality of scoops 11 and the two upper stopper scoops 12 of the two tapes 1. Next, since the second shoulder portions 25*b* include the extensions 13 enveloped by the elastomer, when the flanges 32 and their rear ends 32*a* of the slider 3 come into contact with the second shoulder portions 25*b*, the dimension difference between the lateral dimension of the second shoulder portions 25*b* and the dimension between the rear ends 32*a* of the flanges 32 of the slider 3 can be smaller. This can reduce the resistance caused by the elastomer to permit easy pulling of the slider 3. Furthermore, the two extensions 13 can force the passage portion 22 of the top end stop 2 to sealingly close (see FIGS. 7 and 8), and the stud 31 can be received in the accommodating portion 21. Furthermore, when the slider 3 continues to move upward, each flange 32 of the slider 3 does not have to contact or can slightly abut against (in slight contact with) the respective third shoulder portion 25*c*. Furthermore, each third shoulder portion 25*c* made of elastomer provides a stabilizing effect through slight pressing.

During closure of the two tapes 1, since each first shoulder portion 25*a* is made of rigid plastic, since each second shoulder portion 25*b* is formed by the elastomer that envelops the respective extension 13 made of rigid plastic and that fills the respective recessed portion 14, and since each third shoulder portion 25*c* is made of the elastomer and is not in contact or in slight contact with the slider 3, the interference amount between the top end stop 2 and the slider 3 can be reduced to provide an easy sliding effect for the slider 3. Furthermore, even after long-term frictional contact between the two upper stopper scoops 12 and the slider 3, the two upper stopper scoops 12 are less likely to wear. Furthermore, with the passage portion 22 closed, with the stud 31 of the slider 3 received in the accommodating portion 21, with the two flanges 32 of the slider 3 in tight contact with the two shoulders 25 of the top end stop 2, and with the slider 3 abutting against the stopper portion 24 of the top end stop 2, a better impermeability effect to liquid and air can be attained between the slider 3 and the top end stop 2.

With reference to FIG. 7, on the other hand, when the slider 3 starts to open from the closure state, since the dimension difference between the two second shoulder portions 25*b* and the slider 3 is reduced, the interference amount of the top end stop 2 is reduced. Furthermore, the third shoulder portions 25*c* are made of elastomer and are not in contact or in slight contact with the slider 3. Thus, the slider 3 can easily move from the second ends 1*b* toward the first ends 1*a* of the two tapes 1. Furthermore, the stud 31 of the slider 3 can press against the meshed scoops 11 to separate the plurality of scoops 11 of the two tapes 1 from each other.

Figure 9:
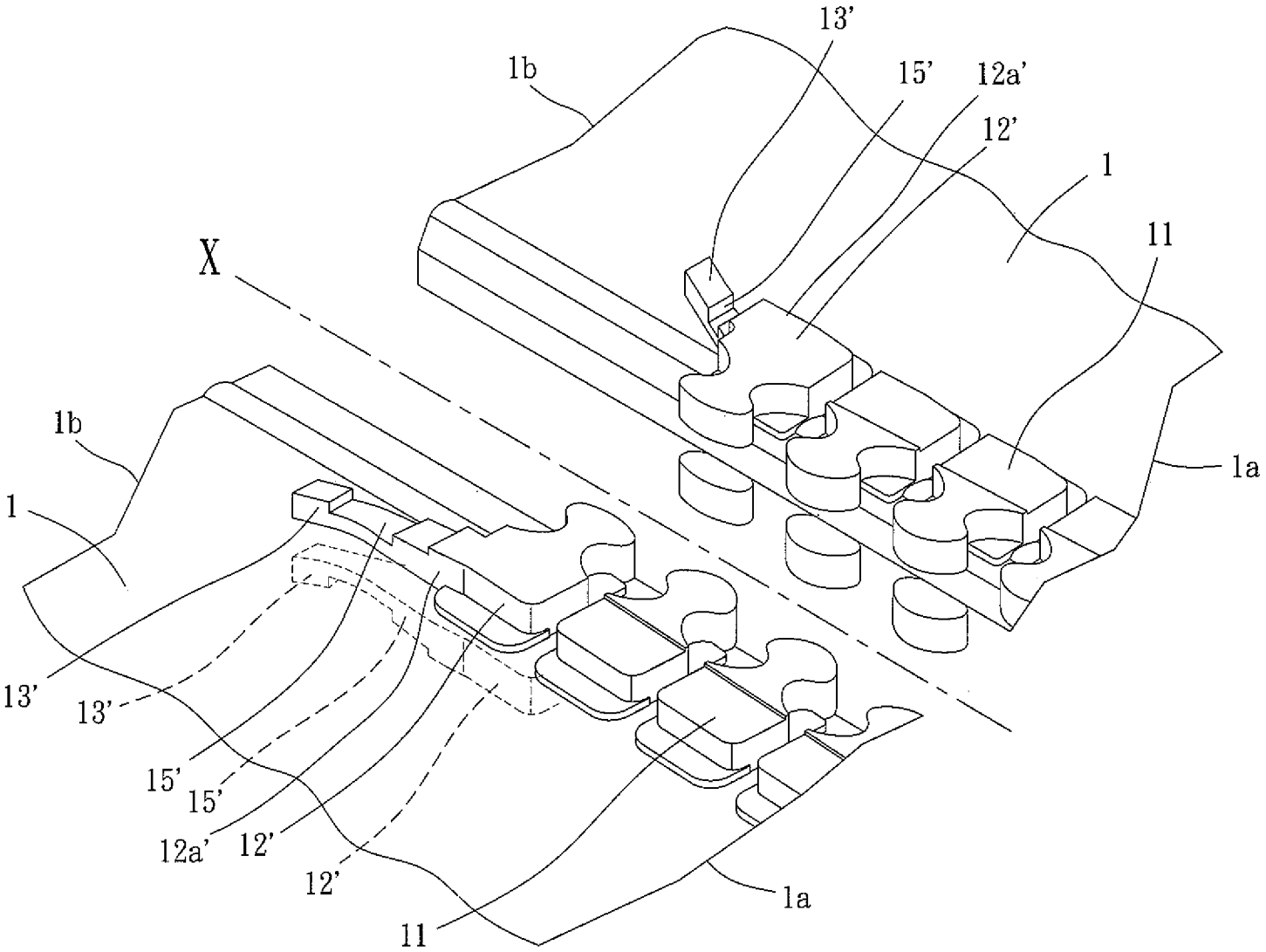
FIG. 9 is a partial, exploded, perspective view of a watertight slide fastener of a second embodiment according to the present invention.
Figure 10:
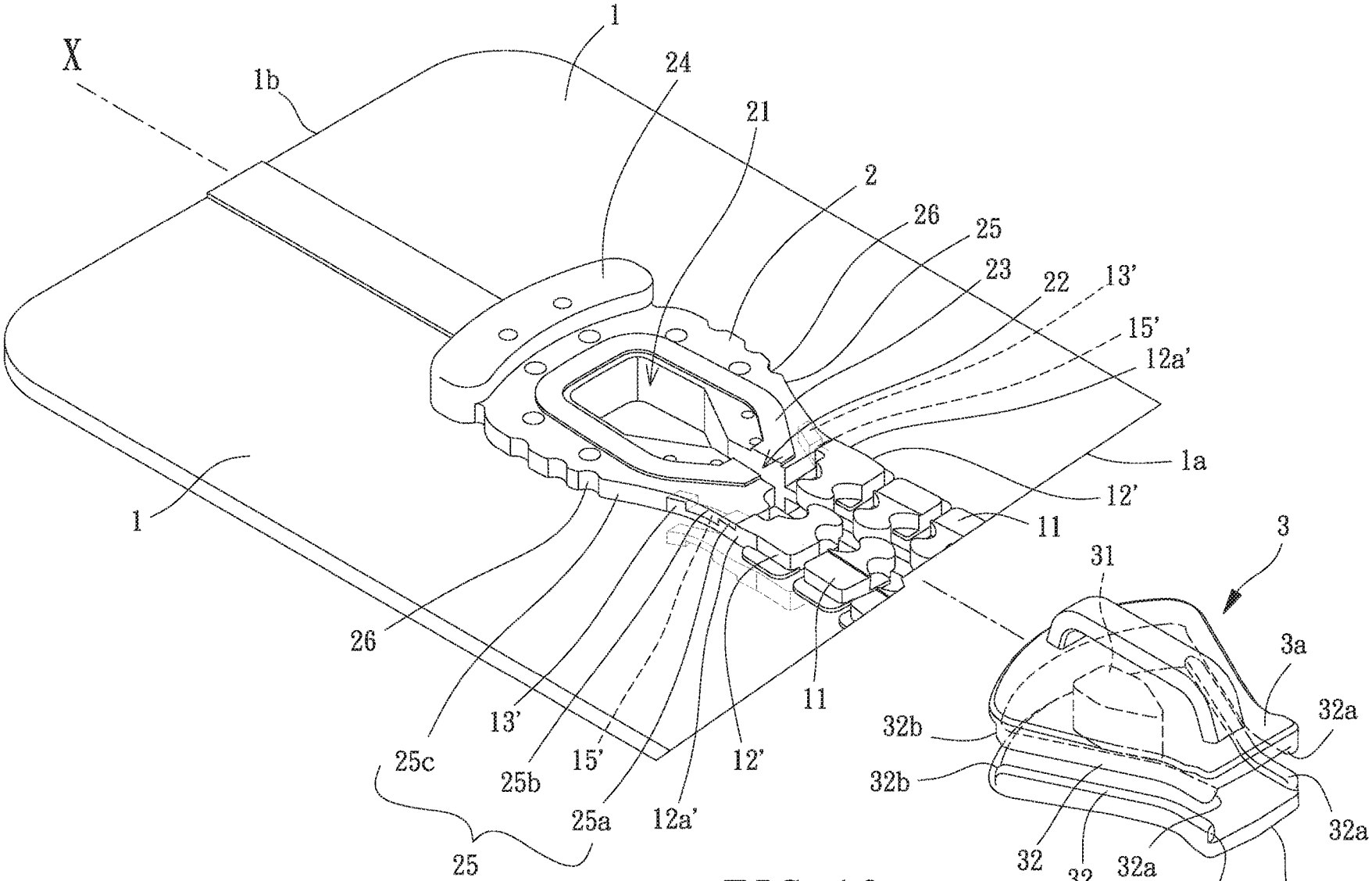
FIG. 10 is an exploded, perspective view of the watertight slide fastener of the second embodiment according to the present invention.

FIGS. 9 and 10 show a watertight slide fastener of a second embodiment according to the present invention, which also includes two tapes 1, a top end stop 2, and a slider 3. Each of the two tapes 1 includes an inner edge on which a plurality of scoops 11 is mounted. The top end stop 2 is contiguous to the last one of the plurality of scoops 11. The slider 3 is configured to close or separate the scoops 11 and the top end stop 2. Each of the inner edges of the two tapes 1 facing each other is provided with the plurality of scoops 11 and an upper stopper scoop 12'. The plurality of scoops 11 on each of the two tapes 1 is consecutively disposed from the first end 1*a* towards the second end 1*b*. The upper stopper scoop 12' on each of the two tapes 1 includes a first end contiguous to the last one of the plurality of scoops 11 on the respective one of the two tapes 1. The upper stopper scoop 12' of each of the two tapes 1 includes a second end having an extension 13'. A thickness between an upper face and a lower face of each extension 13' is preferably smaller than a thickness between an upper face is and a lower face of each upper stopper scoop 12'. Thus, the thickness of each extension 13 is smaller than that of each upper stopper scoop 12. The upper face and the lower face of each extension 13' can include the notches 15'. Furthermore, the second end of the upper stopper scoop 12' of each of the two tapes 1 includes an outer side having a minor protruding portion 12*a'*. The outer side of each extension 13' is flush with a respective one of the minor protruding portions 12*a'*.

With reference to FIG. 10, when forming the top end stop 2 on an upper face and a lower face of each of the two tapes 1, the top end stop 2 can be formed on the upper and lower faces of each of the two tapes 1 by thermoplastic polyurethane (TPU), nylon thermoplastic elastomer, or synthetic rubber through injection molding, such that the elastomer partially envelops the two extensions 13'. Namely, the elastomer merely envelops the upper and lower faces of the two extensions 13' and fills the notches 15', such that the outer sides of the two extensions 13' and the minor protruding portion 12*a'* are exposed and not enveloped. Thus, when slider 3 is pulled, the flanges 32 and their rear ends 32*a* of the slider 3 come in contact with the exposed minor protruding portions 12*a'* and the exposed outer sides of the extensions 13' to close the passage portion 22 of the top end stop 2. Thus, the top end stop 2 imparts a small inference amount and a small resistance to the slider 3, permitting easier pulling of the slider 3. The top end stop 2 further includes two outer sides. Each of the two outer sides of the top end stop 2 has a shoulder 25 from the respective minor protruding portion 12*a'* toward the stopper portion 24. Each shoulder 25 includes a first shoulder portion 25*a*, a second shoulder portion 25*b*, and a third shoulder portion 25*c*. Each first shoulder portion 25*a* corresponds to the minor protruding portion 12*a'* of a respective one of the upper stopper scoops 12 made of rigid plastic. Each second shoulder portion 25*b* corresponds to a respective one of the extensions 13'. Each third shoulder portion 25*c* is made of the elastomer and is a remaining portion beyond a distal end of the respective one of the extensions 13'. Each third shoulder portion 25*c* preferably includes at least one pressure releasing portion 26 in the form of a recess in a respective one of the third shoulder portions 25*c* to reduce the contact area between the third shoulder portion 25*c* and the slider 3.

Figure 11:
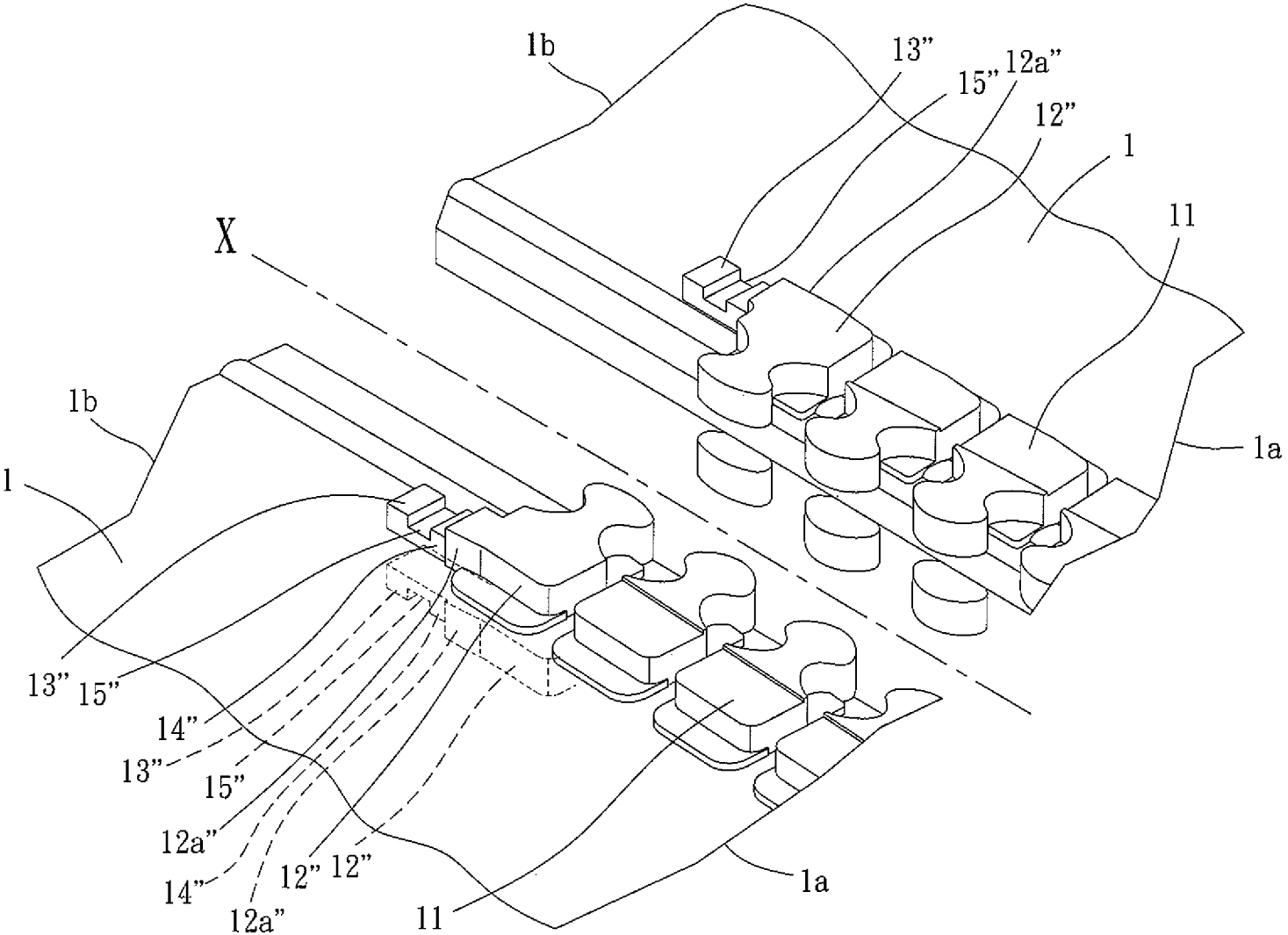
FIG. 11 is a partial, exploded, perspective view of a watertight slide fastener of a third embodiment according to the present invention.
Figure 12:
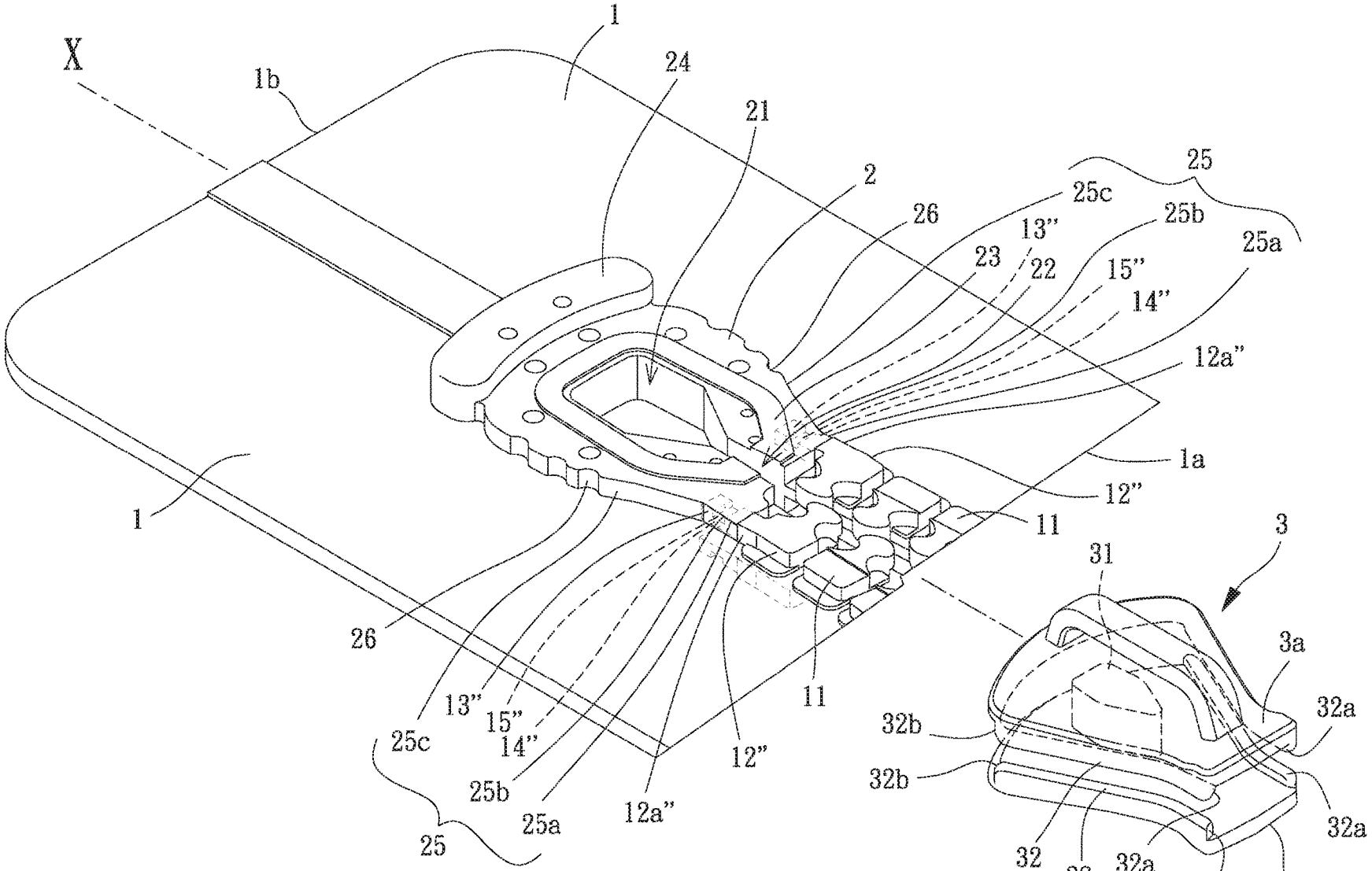
FIG. 12 is an exploded, perspective view of the watertight slide fastener of the third embodiment according to the present invention.

FIGS. 11 and 12 show a watertight slide fastener of a third embodiment according to the present invention, which also includes two tapes 1, a top end stop 2, and a slider 3. Each of the two tapes 1 includes an inner edge on which a plurality of scoops 11 is mounted. The top end stop 2 is contiguous to the last one of the plurality of scoops 11. The slider 3 is configured to close or separate the scoops 11 and the top end stop 2. Each of the inner edges of the two tapes 1 facing each other is provided with the plurality of scoops 11 and an upper stopper scoop 12". The plurality of scoops 11 on each of the two tapes 1 is consecutively disposed from the first end 1*a* towards the second end 1*b*. The upper stopper scoop 12" on each of the two tapes 1 includes a first end contiguous to the last one of the plurality of scoops 11 on the respective one of the two tapes 1. The two upper stopper scoops 12" have the same shape and structure as the plurality of scoops 11 to permit meshing of the upper stopper scoops 12". The upper stopper scoop 12" of each of the two tapes 1 includes a second end having an extension 13". Furthermore, the second end of the upper stopper scoop 12' of each of the two tapes 1 includes an outer side having a minor protruding portion 12*a"*. Each extension 13" can extend rectilinearly or non-rectilinearly. Each outer side of each extension 13" can be flush with or recessed in relation to a respective minor protruding portion 12*a"*. In this embodiment, by using the change in the dimension of the two extensions 13", each outer side of each extension 13" is recessed to an extent farther than the outer face of a respective minor protruding portion 12*a"*, such that a recessed portion 14" is formed in each outer side of each extension 13". A thickness between an upper face and a lower face of each extension 13" is preferably smaller than a thickness between an upper face and a lower face of each upper stopper scoop 12". Two notches 15" are respectively and symmetrically disposed on the upper and lower faces of each extension 13" and preferably correspond to the recessed portions 14".

With reference to FIG. 12, when forming the top end stop 2 on an upper face and a lower face of each of the two tapes 1, the top end stop 2 can be formed on the upper and lower faces of each of the two tapes 1 by thermoplastic polyurethane (TPU), nylon thermoplastic elastomer, or synthetic rubber through injection molding, such that the elastomer envelops the upper and lower faces of the two extensions 13" and fills the recessed portions 14" and the notches 15".

Thus, the top end stop 2 is securely disposed on the two tapes 1 and the two extensions 13". Each of the two outer sides of the top end stop 2 has a shoulder 25 from the respective minor protruding portion 12*a*" toward the stopper portion 24. Each shoulder 25 includes a first shoulder portion 25*a*, a second shoulder portion 25*b*, and a third shoulder portion 25*c*. Each first shoulder portion 25*a* corresponds to the minor protruding portion 12*a*" made of rigid plastic. Each second shoulder portion 25*b* corresponds to a respective one of the extensions 13". Each third shoulder portion 25*c* is a remaining portion beyond a distal end of the respective one of the extensions 13". Each third shoulder portion 25*c* is not in contact or in slight contact with the respective extension 13". Furthermore, each third shoulder portion 25*c* preferably includes at least one pressure releasing portion 26 in the form of a recess in a respective one of the third shoulder portions 25*c* to reduce the contact area between the third shoulder portion 25*c* and the slider 3.

When the slider 3 moves from the first ends 1*a* toward the second ends 1*b* of the two tapes 1, the flanges 32 and their rear ends 32*a* of the slider 3 guide and force the plurality of scoops 11 of the two tapes 1 to mesh with each other. Furthermore, the flanges 32 and their front ends 32*b* of the slider 3 press against the first shoulder portions 25*a* and the second shoulder portions 25*b* of the top end stop 2 while each flange 32 is not in contact or in slight contact with the respective third shoulder portion 25*c*. Thus, the top end stop 2 imparts a small interference amount and a small resistance to the slider 3. Furthermore, the extensions 13" force the passage portion 22 of the top end stop 2 to sealingly close.

In view of the above, in the watertight slide fastener according to the present invention, since only the first shoulder portions 25*a* of the top end stop 2 is made of rigid plastic, since the second shoulder portions 25*b* are elastomer that completely or partially envelops the extensions 13, 13', 13", and since the third shoulder portions 25*c* are not in contact or in slight contact with the slider 3, the lateral dimension difference between the top end stop 2 and the interior of the flanges 32 of the slider 3 can be reduced. Thus, the top end stop 2 imparts a smaller interference amount and a small resistance to permit easy pulling of the slider 3. Furthermore, the two upper stopper scoop 12 made of rigid plastic can withstand long-term frictional contact with the slider 3 to reduce the abrasion of the two upper stopper scoops 12. Thus, even after long-term use of the top end stop 2, the passage portion 22 of the top end stop 2 can still have a better sealing closing effect to attain a better impermeability effect to liquid and air, thereby prolonging the service life of the top end stop 2.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A watertight slide fastener comprising:

two tapes, wherein each of the two tapes includes a waterproof layer and extends in an extending direction, wherein each of the two tapes includes an inner edge on which a plurality of consecutively disposed scoops and an upper stopper scoop are mounted, wherein the plurality of scoops and the upper stopper scoop are made of a rigid plastic, wherein the upper stopper scoop on each of the two tapes includes a first end contiguous to a last one of the plurality of scoops on a respective one of the two tapes, wherein the upper stopper scoop of each of the two tapes includes a second end having an extension and opposite to the first end in the extending direction, wherein the upper stopper scoop has an outer side extending between the first and second ends thereof, and wherein the outer side of the upper stopper scoop at the second end of the upper stopper scoop has a minor protruding portion with a surface protruding from the outer side of the upper stopper scoop at the first end of the upper stopper scoop in a direction away from the inner edge of the tape;

a top end stop formed on an upper face and a lower face of each of the two tapes by an elastomer, wherein the top end stop envelops an upper face of each extension, wherein the top end stop includes two outer sides, and wherein each of the two outer sides of the top end stop has a shoulder; and a slider including an upper body and a lower body, wherein the upper body and the lower body are interconnected by a stud, wherein each of the upper body and the lower body includes two sides, and wherein each of the two sides of each of the upper body and the lower body has a flange.

2. The watertight slide fastener as claimed in claim 1, wherein an outer side of each extension is flush with a respective one of the minor protruding portions, such that the outer side of each extension is exposed and not enveloped by the elastomer.

3. The watertight slide fastener as claimed in claim 2, each shoulder of the top end stop includes a first shoulder portion, a second shoulder portion, and a third shoulder portion, wherein each first shoulder portion corresponds to a respective one of the minor protruding portions, wherein each second shoulder portion corresponds to a respective one of the extensions, and wherein each third shoulder portion is a remaining portion beyond a distal end of the respective one of the extensions.

4. The watertight slide fastener as claimed in claim 3, wherein each third shoulder portion includes at least one pressure releasing portion in a form of a recess in a respective one of the shoulders.

5. The watertight slide fastener as claimed in claim 1, wherein the outer side of each extension includes a recessed portion recessed into a surface of the extension, and wherein the elastomer of the top end stop fills the recessed portion.

6. The watertight slide fastener as claimed in claim 1, wherein the top end stop includes an accommodating portion extending from an upper face through a lower face of the top end stop, wherein the accommodating portion includes a periphery having a protrusion protruding therefrom and a stopper portion, and wherein the protrusion is configured to abut against an inner face of the upper body and an inner face of the lower body.

7. The watertight slide fastener as claimed in claim 1, wherein the upper stopper scoops of the two tapes are made of a rigid plastic.

8. The watertight slide fastener as claimed in claim 1, wherein the elastomer is thermoplastic polyurethane (TPU), nylon thermoplastic elastomer, or synthetic rubber.

9. The watertight slide fastener as claimed in claim 1, wherein each extension is symmetrically formed on the upper face and the lower face of a respective one of the two tapes.

10. The watertight slide fastener as claimed in claim 1, wherein each extension is inclined or curved.

11. The watertight slide fastener as claimed in claim 10, wherein the extensions have an identical inclination angle or an identical curvature.

12. The watertight slide fastener as claimed in claim 1, wherein each extension extends rectilinearly or non-rectilinearly.

* * * * *